US008640398B1

(12) United States Patent
Richmond

(10) Patent No.: US 8,640,398 B1
(45) Date of Patent: Feb. 4, 2014

(54) WELDED LATERAL AND VERTICAL ROD FENCE SECURING STAKE

(76) Inventor: Todd Richmond, Muldrow, OK (US)

( * ) Notice: Subject to any disclaimer, the term of this patent is extended or adjusted under 35 U.S.C. 154(b) by 0 days.

(21) Appl. No.: 13/136,832

(22) Filed: Aug. 11, 2011

Related U.S. Application Data

(63) Continuation-in-part of application No. 12/229,854, filed on Aug. 27, 2008, now abandoned.

(60) Provisional application No. 60/965,672, filed on Aug. 21, 2007.

(51) Int. Cl.
*A01K 3/00* (2006.01)

(52) U.S. Cl.
USPC ..... 52/101; 256/1

(58) Field of Classification Search
USPC ..... 256/1, 24, 25; 52/101; 47/47
See application file for complete search history.

(56) References Cited

U.S. PATENT DOCUMENTS

| | | | | |
|---|---|---|---|---|
| 1,211,059 | A | 1/1917 | Blank | |
| 1,764,284 | A | 6/1930 | Barton | |
| 1,789,628 | A * | 1/1931 | Hobbs | 40/617 |
| 2,923,415 | A | 2/1960 | Brown | |
| 4,301,996 | A | 11/1981 | Holyoak | 256/1 |
| D295,344 | S * | 4/1988 | Pryor et al. | D6/323 |
| 6,289,639 | B1 | 9/2001 | Robertson | 52/101 |
| 7,216,854 | B2 | 5/2007 | Bryan | 256/25 |
| D571,430 | S | 6/2008 | Richmond | D22/122 |
| 7,562,453 | B1 | 7/2009 | Benner et al. | 29/897.31 |
| D598,142 | S | 8/2009 | Kircher | D25/164 |
| D634,448 | S | 3/2011 | Richmond | D25/133 |
| 2002/0190248 | A1 | 12/2002 | Ohai | 256/64 |
| 2005/0184281 | A1 | 8/2005 | Bryan | 256/25 |

OTHER PUBLICATIONS

U.S. Appl. No. 29/348,553, Richmond.

* cited by examiner

*Primary Examiner* — Jeanette E Chapman
*Assistant Examiner* — Daniel Kenny
(74) *Attorney, Agent, or Firm* — Keisling & Pieper PLC; David B. Pieper

(57) ABSTRACT

The present invention is directed to a fence stake including a lateral rod side connected to a vertical rod at spaced intervals. An alternative embodiment includes bending the vertical stake in a complete reversal to also connect the end of the vertical rod to the lateral rod to provide a second connection location and directly transfer hammer blow to the lateral rod. A further alternative embodiment includes adding an angled rod that is connected to the lateral rod, connected to the vertical rod, or connected to both the lateral rod and the vertical rod.

1 Claim, 2 Drawing Sheets

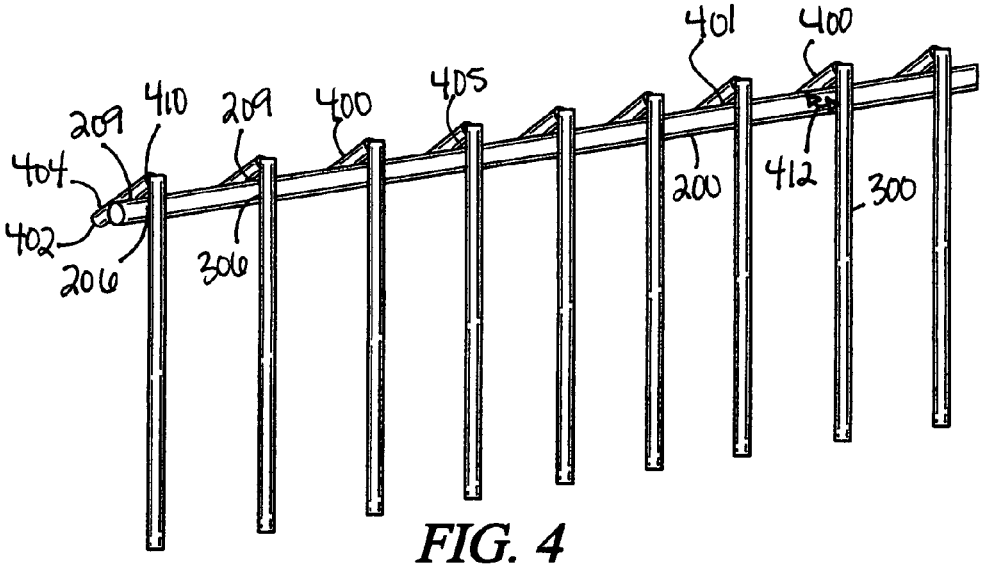
FIG. 4
FIG. 5
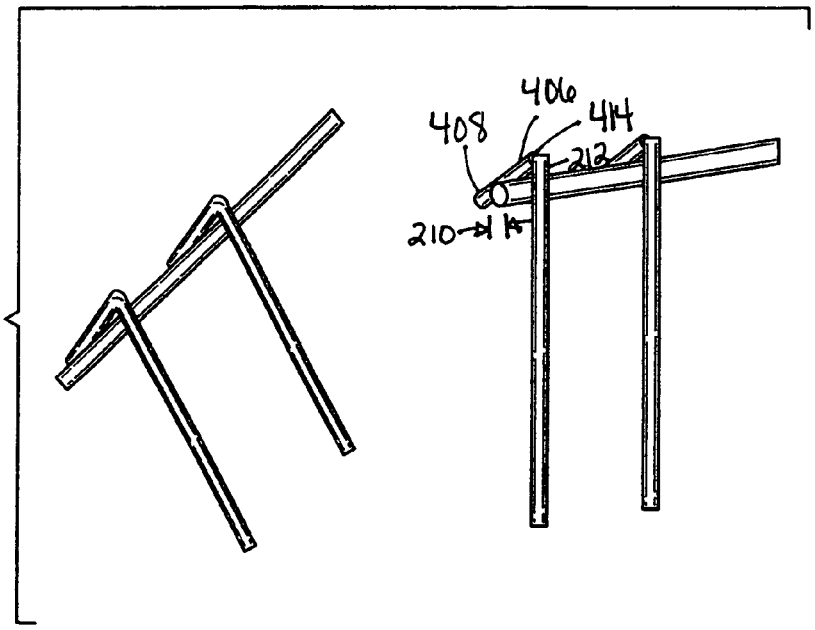

WELDED LATERAL AND VERTICAL ROD FENCE SECURING STAKE

CROSS-REFERENCE TO RELATED APPLICATIONS

This application claims priority to and is a continuation in part of U.S. patent application Ser. No. 12/229,854, filed Aug. 27, 2008 now abandoned entitled DIG DEFENCE which claims priority to and is a continuation of U.S. Provisional Application 60/965,672, filed Aug. 21, 2007 entitled Quick Fix Pen Stakes.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in fencing. More particularly, the invention relates to improvements particularly suited for securing the bottom of fences using ground stakes. In particular, the present invention relates specifically to an elongated fence and ground engaging stake system for impact insertion into the ground.

2. Description of the Known Art

As will be appreciated by those skilled in the art, fences are known in various forms. A typical fence has the problem of either a gap at the bottom of the fence that needs to be covered, or may be a flexible fence such as wire or chain link that allows for the bottom of the fence to be pushed out of the way by animals. Also, it is known that animals dig under fences to get past the fence. The present invention is designed to overcome these problems.

SUMMARY OF THE INVENTION

The present invention is directed to an elongated staking device using an elongated lateral rod welded to the upper end of vertical rods having lower ground engaging extensions at equally spaced intervals along the lateral rod. In accordance with another exemplary embodiment of the present invention, the angled rods are positioned in association with the vertical rods to form hooks for engaging a fence rail or wire. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 4 is a front view of a third embodiment of the fence stake with nine vertical stakes.

FIG. 5 is a relative font view showing the vertical installation and relative angled installation orientations of the third embodiment with two vertical stakes.

DETAILED DESCRIPTION OF THE INVENTION

Figure 1:
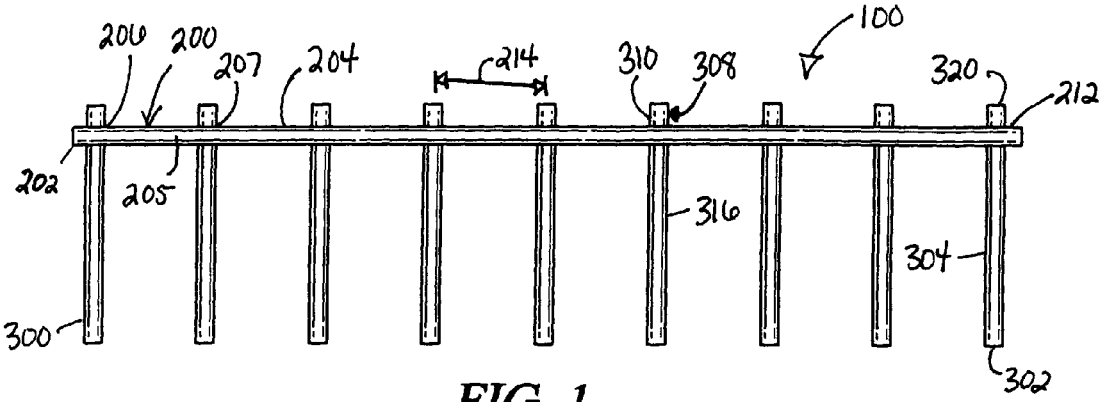
FIG. 1 is a front view of a fence stake.

The preferred embodiment of the present invention is directed to a fence stake 100 as shown in FIGS. 1 through 5. The quick fix stake 100 consists of a lateral rod 200 having a first lateral rod end 202 starting a rod body 204 that extends laterally to a second lateral rod end 212. The rod body 204 forms a side 205 with lateral side welding locations 206 and a top 207 with lateral top welding locations 208 and a lateral angled welding location 209. The rod body 204 also defines a rod thickness 210. The rod body 204 has a length broken up by the spacing interval 214. The rod body 204 is connected by welding to vertical rods 300 at lateral side welding locations 206 at each of the spacing interval 214.

In the preferred embodiment, each vertical rod 300 includes a first vertical rod end 302 beginning a rod body 304 that extends to a second vertical rod end 320. The rod body 304 defines vertical side welding location 306 separably defining an upper vertical extension 308 from a lower vertical extension 316. The upper vertical extension 308 includes a neck extension 310. A one half inch neck extension 310 is used in the preferred embodiment. In the embodiment shown in FIG. 1, only one welding location is used and the second rod end 320 is at the most distal point of the neck extension 310. The vertical rods are placed over the bottom wire of any fence that needs to be repaired, and hammered into the ground to help hold the fence down and to correct the problem area or to make the entire perimeter dig resistant. Different gauges of material, such as plastic or steel, and different shapes, lengths and designs are envisioned to prevent predators from digging in and animals from digging out under a fence, and a one quarter inch round steel rod is used in the preferred embodiment. Typical spacing is three and one half inches as these gaps are suitable to stop most animals. Lateral rod lengths of twenty eight inches or shorter are preferred for ease of handling and installation.

Figure 2:
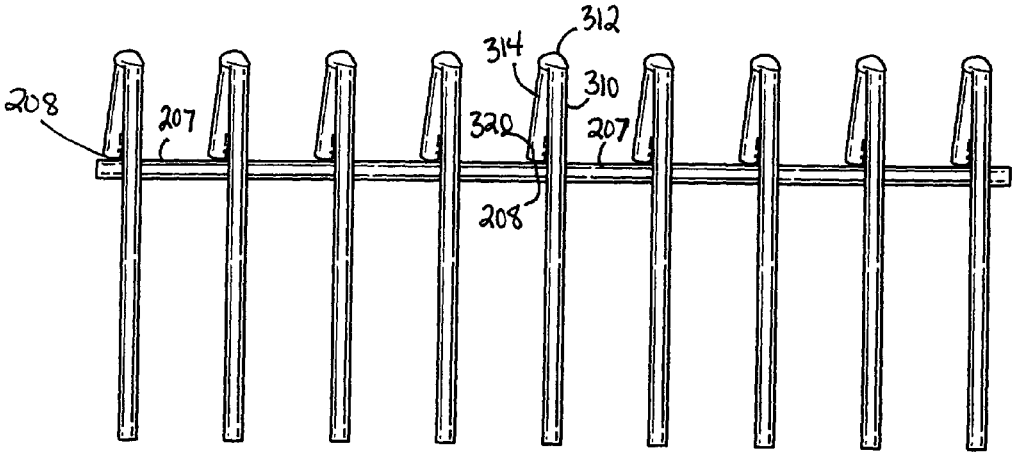
FIG. 2 is a front view of a second embodiment of the fence stake with nine vertical stakes.
Figure 3:
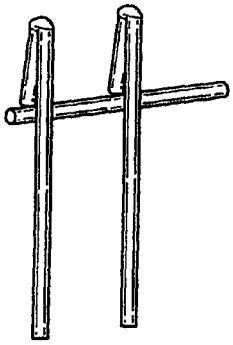
FIG. 3 is a front view of a the second embodiment with two vertical stakes.

FIG. 2 is a front view of a second embodiment of the fence stake with nine vertical stakes and FIG. 3 is a front view of a the second embodiment with two vertical stakes. In these figures, it may be seen how the upper vertical extension 310 includes a neck extension 310 that ends at a returning head bend 312 of one hundred and eighty degrees to connect to a neck return 314 of sufficient length to return the second rod end 320 to the top 207 of the lateral rod 200. In this manner, the neck return 314 places the second rod end 320 at a lateral top welding location 208. This allows for both the side and a top weld to hold the vertical rod in position. This is important for impact hammering of the rod into the ground to reduce stress on the side weld. It is recommended to bend the wire before welding to be able to handle the vertical wire freely during the bending process.

FIG. 4 is a front view of a third embodiment of the fence stake 100 with nine vertical stakes and FIG. 5 is a relative font view showing the angled installation and relative vertical installation orientations of the third embodiment with two vertical stakes. In this embodiment, an angled rod 400 is welded at an angle 412 referenced against the vertical rod 300. An angled rod is about one inch in length in the preferred embodiment and may be separate from the vertical rod, welded to the vertical rod, or formed by bending the vertical rod one hundred and thirty five degrees. The angled rod is connected by welding at a first angled welding location 401 at an angle of one hundred and thirty five degrees from the vertical rods and in a orientation perpendicular to the lateral rod 200 in this embodiment. Each angled rod 400 includes a first angled rod end 402 starting an angled rod body 404 that extends to a second angled rod end 410. The angled rod body 404 includes a rod bottom 405 having the first angled welding location 401 in this embodiment. A top welding location could also be used. The angled welding location 401 separates the upper angled extension 406 from the lower angled extension 408. The upper angled extension is shown welded at a second angle welding location 414 located at the second angled rod end 410 in this embodiment to connect to the second vertical rod end 212 to provide a second welding location in this embodiment.

Reference numerals used throughout the detailed description and the drawings correspond to the following elements:

- Fence stake 100
- Lateral rod 200
- First lateral rod end 202
- Lateral rod body 204
  - Lateral side welding location 206
  - Top 207
  - Lateral top welding location 208
  - Lateral angled welding location 209
  - Rod thickness 210
- Second lateral rod end 212
- Spacing lateral interval 214
- Vertical rod 300
- First vertical rod end 302
- Vertical body 304
  - Vertical side welding location 306
  - Upper vertical extension 308
    - Neck extension 310
    - Reversing head bend 312
    - Neck return 314
  - Lower vertical extension 316
    - Second vertical rod end 320
- Angled rod 400
- First angled welding location 401
- First angled rod end 402
- Angled body 404
  - Angled rod bottom 405
  - Upper angled extension 406
  - Lower angled extension 408
- Second angled rod end 410
- Angle 412
- Second angle welding location 414

From the foregoing, it will be seen that this invention well adapted to obtain all the ends and objects herein set forth, together with other advantages which are inherent to the structure. It will also be understood that certain features and sub combinations are of utility and may be employed without reference to other features and sub combinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining, ' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

The invention claimed is:

1. A fence stake comprising:

a lateral rod having a lateral rod body defining lateral side welding locations, each of said lateral side welding locations having an adjacent lateral top welding location;

a plurality of vertical rods, each vertical rod having a vertical body defining a vertical side welding location, the vertical side welding location welded to one of said lateral side welding locations;

each vertical rod defining an upper vertical extension having a neck extension connected to a reversing head bend;

the reversing head bend connected to the neck extension;

the neck extension defining a rod end;

the rod end welded to the lateral rod at said adjacent lateral top welding location.

* * * * *